US006325664B1

(12) United States Patent
Someda et al.

(10) Patent No.: US 6,325,664 B1
(45) Date of Patent: Dec. 4, 2001

(54) SHIELDED MICROELECTRONIC CONNECTOR WITH INDICATORS AND METHOD OF MANUFACTURING

(75) Inventors: Derek T. Someda, San Diego; Ronald A. Shutter, Encinitas, both of CA (US)

(73) Assignee: Pulse Engineering, Inc., San Diego, CA (US)

( * ) Notice: Subject to any disclaimer, the term of this patent is extended or adjusted under 35 U.S.C. 154(b) by 0 days.

(21) Appl. No.: 09/524,311

(22) Filed: Mar. 13, 2000

Related U.S. Application Data

(60) Provisional application No. 60/123,988, filed on Mar. 11, 1999.

(51) Int. Cl.[7] ..... H01R 3/00
(52) U.S. Cl. ..... 439/490
(58) Field of Search ..... 439/490, 620, 439/607

(56) References Cited

U.S. PATENT DOCUMENTS

| | | | |
|---|---|---|---|
| 3,422,394 | 1/1969 | Antes . | |
| 4,109,986 | 8/1978 | Mouissie . | |
| 4,461,522 | 7/1984 | Bakermans et al. . | |
| 4,695,115 | 9/1987 | Talend | 439/76 |
| 4,701,002 | 10/1987 | Mouissie | 439/426 |
| 4,726,638 | 2/1988 | Farrar et al. | 439/620 |
| 4,772,224 | 9/1988 | Talend | 439/607 |
| 4,978,317 | 12/1990 | Pocrass | 439/490 |
| 4,995,834 | 2/1991 | Hasegawa | 439/620 |
| 5,011,438 | 4/1991 | Awbrey | 439/825 |
| 5,015,204 | 5/1991 | Sakamoto et al. | 439/620 |
| 5,015,981 | 5/1991 | Lint et al. | 336/65 |
| 5,069,641 | 12/1991 | Sakamoto et al. | 439/620 |
| 5,139,442 | 8/1992 | Sajaniti et al. | 439/620 |
| 5,178,563 | 1/1993 | Reed | 439/676 |
| 5,239,748 | 8/1993 | Hamilton | 29/843 |
| 5,282,759 | 2/1994 | Sakamoto et al. | 439/620 |
| 5,397,250 | 3/1995 | Briones | 439/620 |
| 5,399,107 | 3/1995 | Gentry et al. | 439/676 |
| 5,403,207 | 4/1995 | Briones | 439/620 |
| 5,456,619 | 10/1995 | Belopolsky et al. | 439/620 |
| 5,475,921 | 12/1995 | Johnston | 29/878 |
| 5,587,884 | 12/1996 | Raman | 361/728 |
| 5,647,767 | 7/1997 | Scheer et al. | 439/620 |
| 5,685,737 * | 11/1997 | Morin et al. | 439/490 |

(List continued on next page.)

FOREIGN PATENT DOCUMENTS

| | | |
|---|---|---|
| 654865 A1 | 5/1995 | (EP) . |
| WO94/05059 | 3/1994 | (WO) . |

*Primary Examiner*—Neil Abrams
*Assistant Examiner*—Javaid Nasri
(74) *Attorney, Agent, or Firm*—Knobbe Martens Olson & Bear LLP

(57) ABSTRACT

A microelectronic connector having indicating devices which are located external to the connector body. In one embodiment, one or more channels are formed in the exterior of the connector body which receive the devices and their leads. The channels are formed generally on the connector surface proximate to the circuit board to which the connector leads are being mated, thereby minimizing the length of the leads. The channels are designed to retain the leads of the indicating devices in a substantially fixed relationship to the connector body, thereby obviating the need for a cavity or recess for the indicating device, or apertures leading from the cavity/recess to the exterior of the package. A noise shield may further be installed on the connector body which helps retain the aforementioned indicating devices within external channels formed in the connector body. In one embodiment, a one-piece metallic shield is folded around the exterior of the connector body and indicating devices, thereby retaining the LEDs in place. In a second embodiment, the shield is contoured to the channel of the connector body such that the indicating devices are external to the shield and connector, thereby shielding the connector conductors and magnetics from EMI generated by the indicating devices as well as that from external sources. A method of fabricating the connector of the present invention is also disclosed.

13 Claims, 6 Drawing Sheets

U.S. PATENT DOCUMENTS

| | | | | |
|---|---|---|---|---|
| 5,687,233 | | 11/1997 | Loudermilk et al. | 379/442 |
| 5,700,157 | * | 12/1997 | Chung | 439/490 |
| 5,736,910 | | 4/1998 | Townsend et al. | 333/181 |
| 5,766,043 | | 6/1998 | Talend | 439/676 |
| 5,872,492 | | 2/1999 | Boutros | 333/182 |
| 5,876,239 | | 3/1999 | Morin et al. | 439/490 |
| 5,928,005 | | 7/1999 | Li et al. | 439/825 |
| 5,957,730 | * | 8/1998 | Wang | 439/676 |
| 6,116,946 | * | 7/1998 | Lewis et al. | 439/490 |

* cited by examiner

SHIELDED MICROELECTRONIC CONNECTOR WITH INDICATORS AND METHOD OF MANUFACTURING

The benefit under 35 U.S.C. §119(e) of the following U.S. provisional application entitled SHIELDED MICROELECTRONIC CONNECTOR WITH INDICATORS AND METHOD OF MANUFACTURING, Ser. No. 60/123,988, filed Mar. 11, 1999, is hereby claimed.

BACKGROUND OF THE INVENTION

1. Field of the Invention

The invention relates generally to miniature electrical connectors used in printed circuit board and other microelectronic applications, and to an improved microelectronic connector having an electromagnetic interference shield and indicators, and a method of fabricating the same.

2. Description of Related Technology

Existing microelectronic electrical connectors (such as those of the RJ 45 or RJ 11 type) frequently incorporate light emitting diodes (LEDs) or other indication devices within or as part of the connector body itself. The indicating devices provide an indication to the user of various functions associated with the connector such as electrical continuity or the operational status of the connector. Typically, these indicating devices are contained within discrete slots or cavities within the connector body, and their associated leads run down the back of the connector body in order to facilitate electrical connection with a circuit board or other device. Furthermore, the noise shield (if installed) is external to the connector body and the indicating devices. However, the fabrication of such prior art connectors require significant labor in preparing the mold from which the connector body is formed. The cavities or discrete slots, and any electrical lead penetrations associated with the indicating devices contained therein, must be considered in designing and fabricating the mold. Additionally, when the indicating devices are in close physical proximity to the connector conductors and magnetics and not shielded with respect thereto, significant electromagnetic interference (EMI) can be transmitted from the indicating devices to the magnetics or conductors, thereby increasing unwanted conductive emissions from the connector.

Accordingly, it would be most desirable to provide an improved design of microelectronic connector with indicating devices which would reduce the amount of labor associated with preparing the molds used to form the connector body. Similarly, it would be desirable to provide an improved connector having indicating devices which minimized the EMI or noise transferred to the internal electrical components of the connector from the indicating devices.

SUMMARY OF THE INVENTION

The invention provides an improved microelectronic connector with indicating devices and EMI shielding, and methods of fabricating the same.

In a first aspect of the invention, an improved microelectronic connector is disclosed which utilizes indicating devices such as LEDs which are located external to the connector body. In one embodiment, one or more channels are formed in the exterior of the connector body which receive the devices and their leads. The channels are formed generally on the connector surface proximate to the circuit board (or other device) to which the connector leads are being mated, thereby minimizing the length of the leads and facilitating their direct connection to the circuit board. The channels are designed to retain the leads of the indicating devices in a substantially fixed relationship to the connector body, thereby obviating the need for a cavity or recess for the indicating device, or apertures leading from the cavity/recess to the exterior of the package.

In a second aspect of the invention, an improved microelectronic connector is disclosed having a noise shield which helps retain the aforementioned indicating devices within external channels formed in the connector body. In one embodiment, a one-piece metallic shield is folded around the exterior of the connector body and indicating devices (LEDs), thereby retaining the LEDs in place within the portion of the connector body proximate to the circuit board. In a second embodiment, the shield is contoured to the channel of the connector body such that the indicating devices are external to the shield and connector, thereby shielding the connector conductors and magnetics from EMI generated by the indicating devices as well as that from external sources.

In a third aspect of the invention, a method of fabricating the connector of the present invention is described.

A more complete understanding of the invention and its advantages will become evident to those skilled in the art from a consideration of the following detailed description when read in conjunction with the appended drawings wherein like numerals refer to like parts throughout.

DETAILED DESCRIPTION OF THE INVENTION

Reference is now made to the drawings wherein like numerals refer to like parts throughout.

Figure 1:
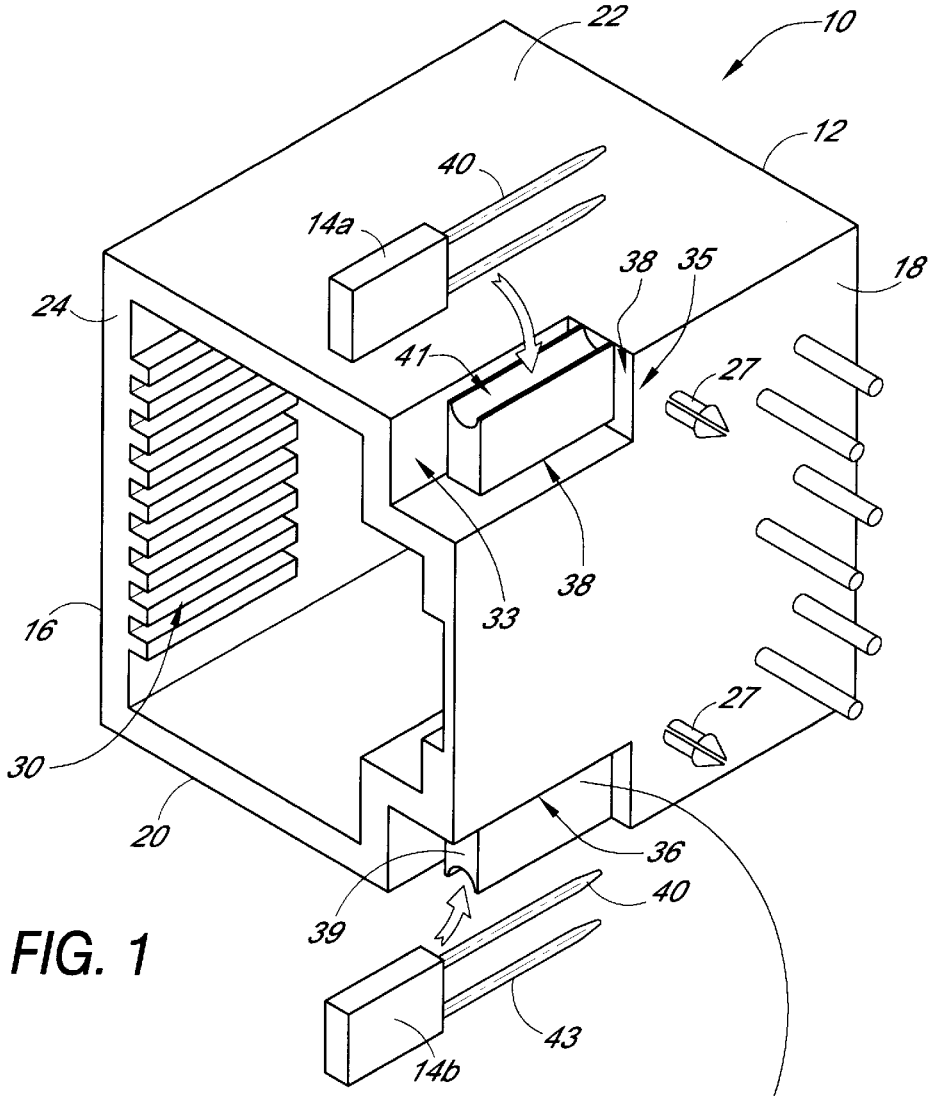
FIG. 1 is an exploded perspective view of a connector prior to assembly in accordance with aspects of the invention.
Figure 1A:
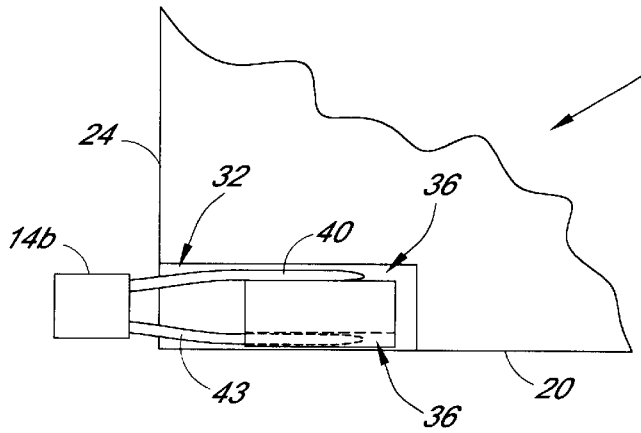
FIG. 1*a* is a detail view of the channels and grooves of the connector body of the present invention.
Figure 1C:
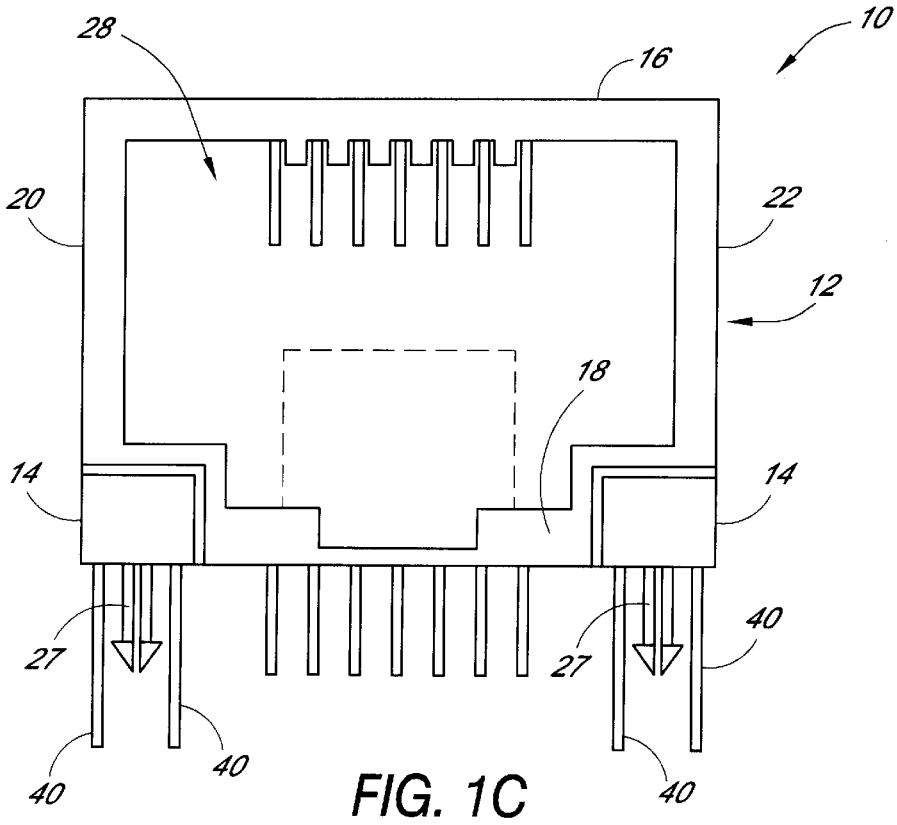
FIG. 1*c* is a front view of the connector of FIG. 1 when assembled.
Figure 1B:
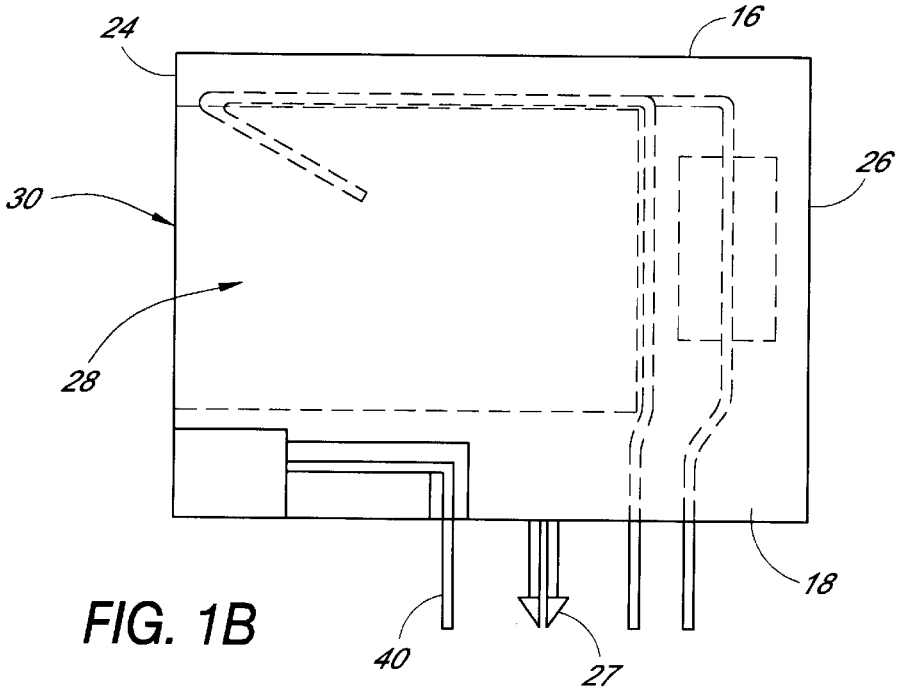
FIG. 1*b* is a side plan view of the connector of FIG. 1 when assembled.

FIGS. 1 and 1*a*–1*c* show a first embodiment of the microelectronic connector 10 constructed according to the principles of the present invention. In this embodiment, the connector 10 is composed of, inter alia, a connector body 12 and indicating devices 14*a*–*b*. The connector body 12 is comprised generally of top and bottom walls 16, 18, side walls 20, 22, and front and rear walls 24, 26, and one or more mounting devices 27 (such as split pins as shown in FIG. 1). A cavity 28 is disposed within the body 12, the cavity being accessible via an aperture 30 located in the front wall 24.

The aperture 30 and cavity 28 can be adapted and varied in configuration to receive any one of a number of electrical connector configurations such as RJ11 or RJ45, as is well know in the art.

The body 12 of the present embodiment further includes two channels 32, 33 formed generally on the bottom comers 34, 35 of the body 12. The channels 32, 33 are configured to receive indicating devices 14*a–b*. In one embodiment, the indicating devices 14*a–b* are light emitting diodes (LEDs) having a generally rectangular box-like shape. However, it will be appreciated that other types of devices such as incandescent bulbs or LCDs, and other shapes (such as devices having a round cross-section) can be used. Two pairs of lead grooves 36, 38 and a land 39 are formed on the exterior of the bottom wall 18. The grooves 36, 38 are in communication with their respective channels 32, 33 and are of a size so as to frictionally receive the leads 40 of the LEDs 14. The frictional fit of the leads 40 in the grooves 36, 38 permits the LEDs to be retained within their respective channels without the need for other retaining devices or adhesives. It will be appreciated, however, that such additional retaining devices or adhesives may be desirable to add additional mechanical stability to the LEDs when installed or to replace the grooves altogether. Additionally, the lead 40 which lies in the groove 36 can be heat staked.

The outer edge of each land 39 further optionally includes a recess 41 for retaining the outer LED lead 43 when a noise shield is installed around the connector body 12 (see discussion of other embodiments below). The aforementioned location of the channels 32, 33, grooves 36, 38, and lands 39 allows the leads 40 of the LEDs to be deformed downward at any desired angle or orientation such that they may be readily and directly mated with the circuit board 50 or other devices (not shown) while minimizing total lead length. Reduced lead length is desirable from both cost and radiated noise perspectives. The placement of the LEDs in the grooves 36, 38 and channels 32, 33 further permits the outer profile of the connector to be minimized, thereby economizing on space within the interior of any parent device in which the connector 10 is used.

It will be noted that while channels 32, 33, grooves 36, 38, and lands 39 are described above, other types of forms and/or retaining devices, as well as locations therefore, may be used with the present invention. For example, the aforementioned indicating devices 14 can be mounted on the bottom surface of the connector using only adhesive and the grooves 36, 38 to retain the leads 40 and align the devices 14. Alternatively, the channels and grooves can be placed laterally across the bottom surface of the connector body 12 such that the indicating devices 14 are visible primarily from the side of the connector, or from the top of the connector. Many such permutations are possible and considered to be within the scope of the invention described herein.

Figure 2:
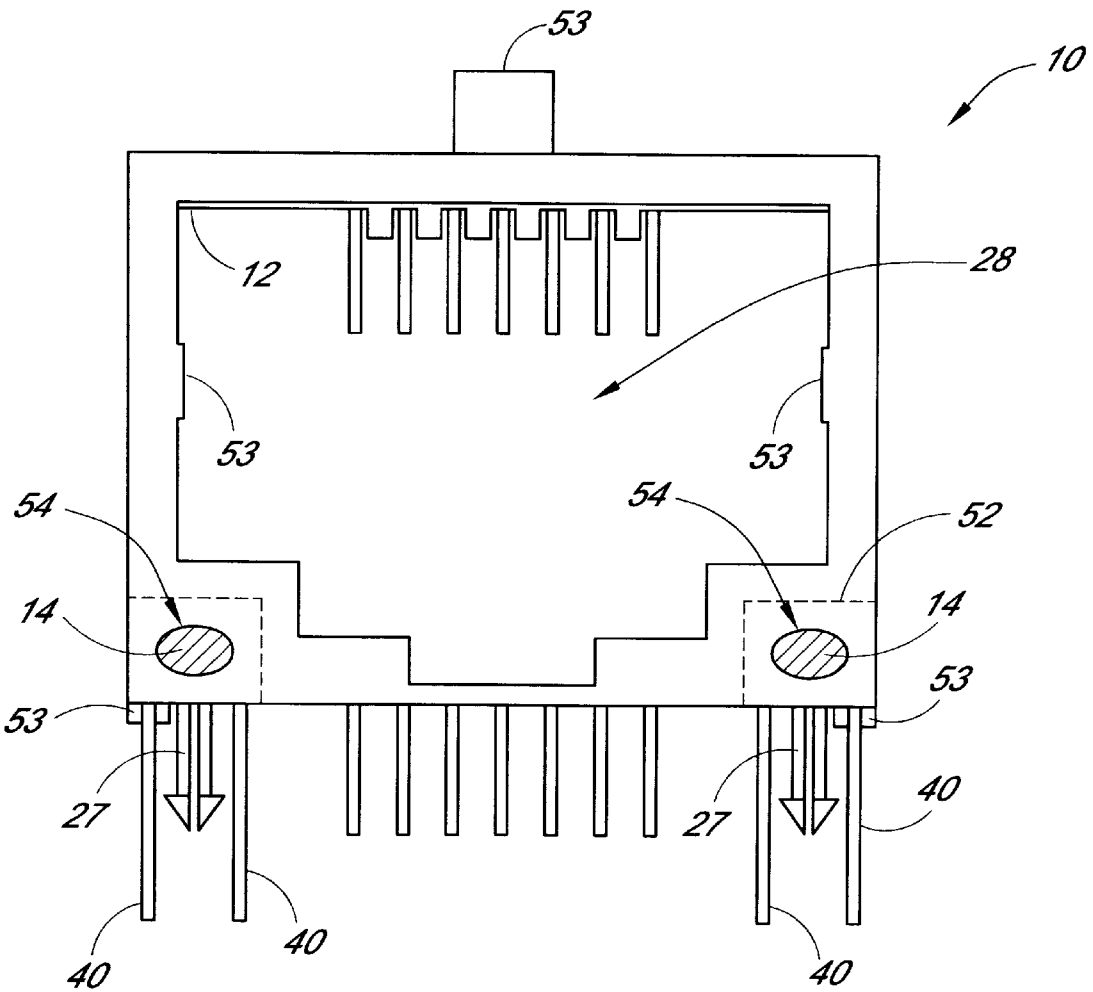
FIG. 2 is a front plan view of a connector having indicating devices contained within an integral EMI shield.
Figure 2B:
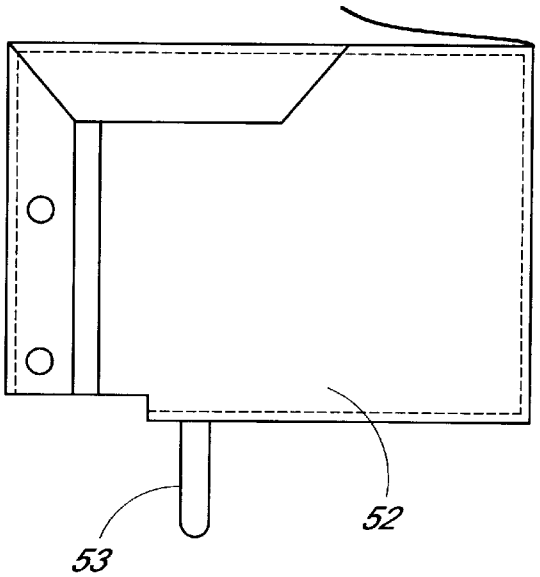
FIG. 2*b* illustrates the assembly of the noise shield of FIG. 2*a*.
Figure 2A:
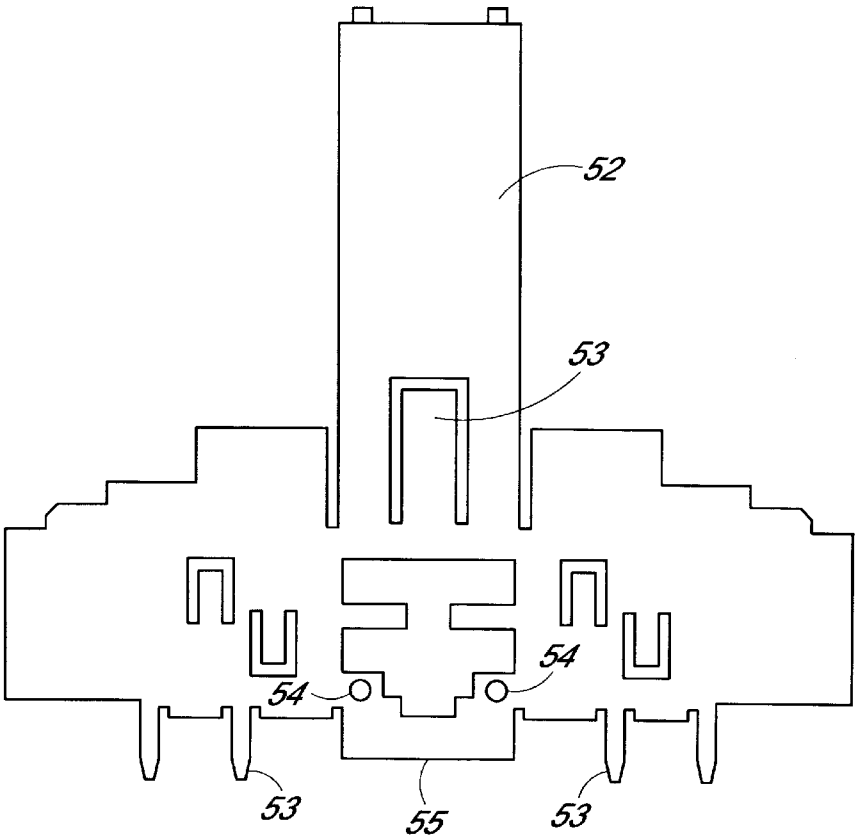
FIG. 2*a* is a plan view of the noise shield of the connector of FIG. 2 prior to installation on the connector.

Referring now to FIGS. 2, 2*a* and 2*b*, a second embodiment of the improved connector of the present invention is disclosed. In addition to the components already described with reference to the embodiment of FIG. 1, the embodiment of FIG. 2 further comprises a noise or EMI shield 52 which generally surrounds the connector body 12 and indicating devices 14. The shield 52 can be of metallic one piece construction as shown in FIGS. 2*a* and 2*b*, although other materials and configurations may be used. Portions of the shield 52 are folded around the body 12, and tabs 53 on the shield are bent into place to secure the shield 52 to the body 12. As shown in FIG. 2, the shield 52 of the present embodiment can also assist in retaining the indicating devices 14 within the channels 32, 33 of the body 12 when the connector is assembled via the frontal tab 55 which is deformed down and back under the indicating devices 14 upon assembly. The shield 52 further contains viewing ports 54 to allow viewing of the indicating devices 14 by the operator. While the viewing ports 54 shown in FIGS. 2*a* and 2*b* are circular, it will be recognized that other shapes may be used.

It will be noted that the indicating devices 14 may also be retained within the channels 32, 33 solely by the shield 52 when it is placed around the connector body 12, and the lands 39 and grooves 36, 38 described above may be eliminated.

Figure 3:
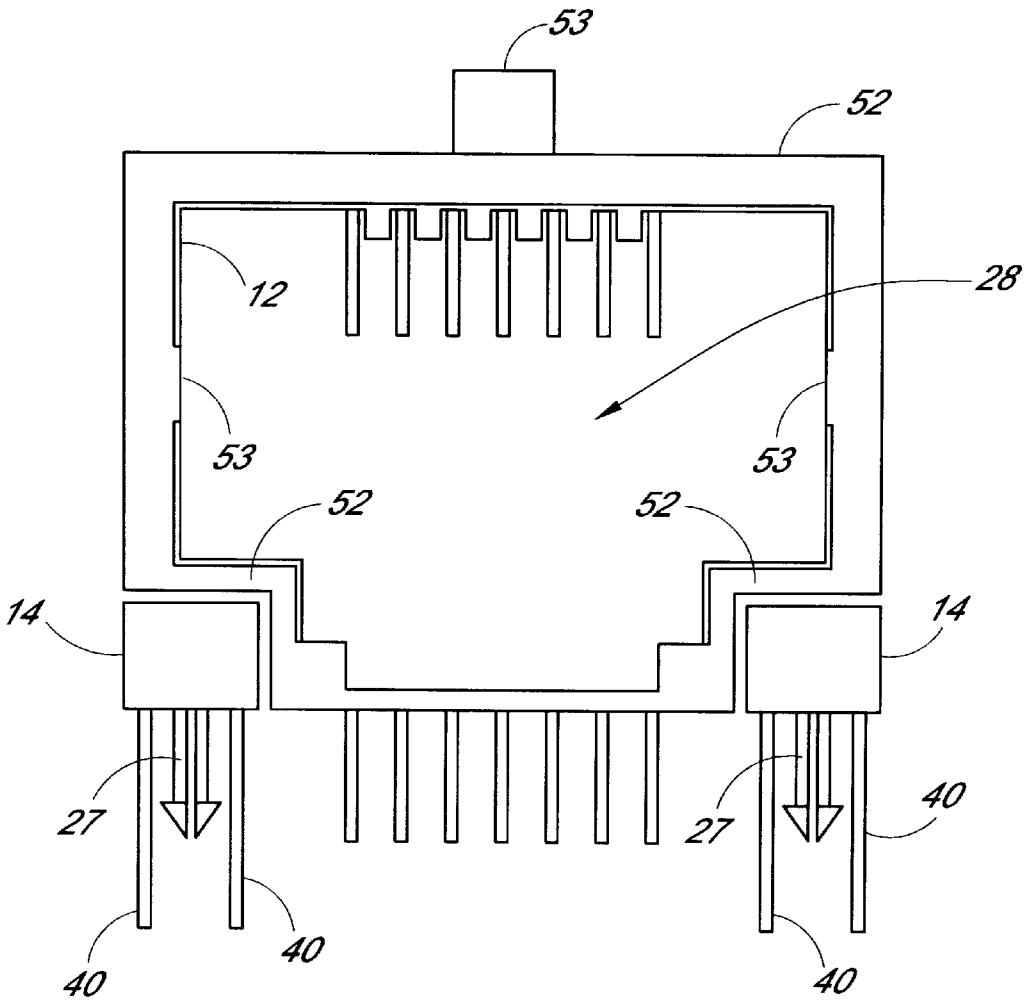
FIG. 3 is a front plan view of a connector according to the present invention having indicating devices external to the integral EMI shield.

Referring now to FIG. 3, a third embodiment of the connector of the present invention is disclosed. In this embodiment, the shield 52 is deformed into the channels 32, 33. The indicating devices 14 are located within the channels 32, 33 yet outside or external to the shield 52 so as to shield the connector and internal components including, for example, magnetics (inductive reactors or filters) and conductors, from EMI generated by the indicating devices. The indicating devices 14 are retained within the grooves 36, 38 formed in the connector body 12 as previously described, and may also be bonded to the shield and/or connector body using an adhesive (not shown). Additionally, if desired, the shield 52 may be fabricated such that retaining tabs of the shield (not shown) may be deformed around the indicating devices to assist in retaining them in position. It will again be noted that while the embodiment of FIG. 3 uses a one piece metallic shield 52, other materials and configurations may be used.

Figure 4:
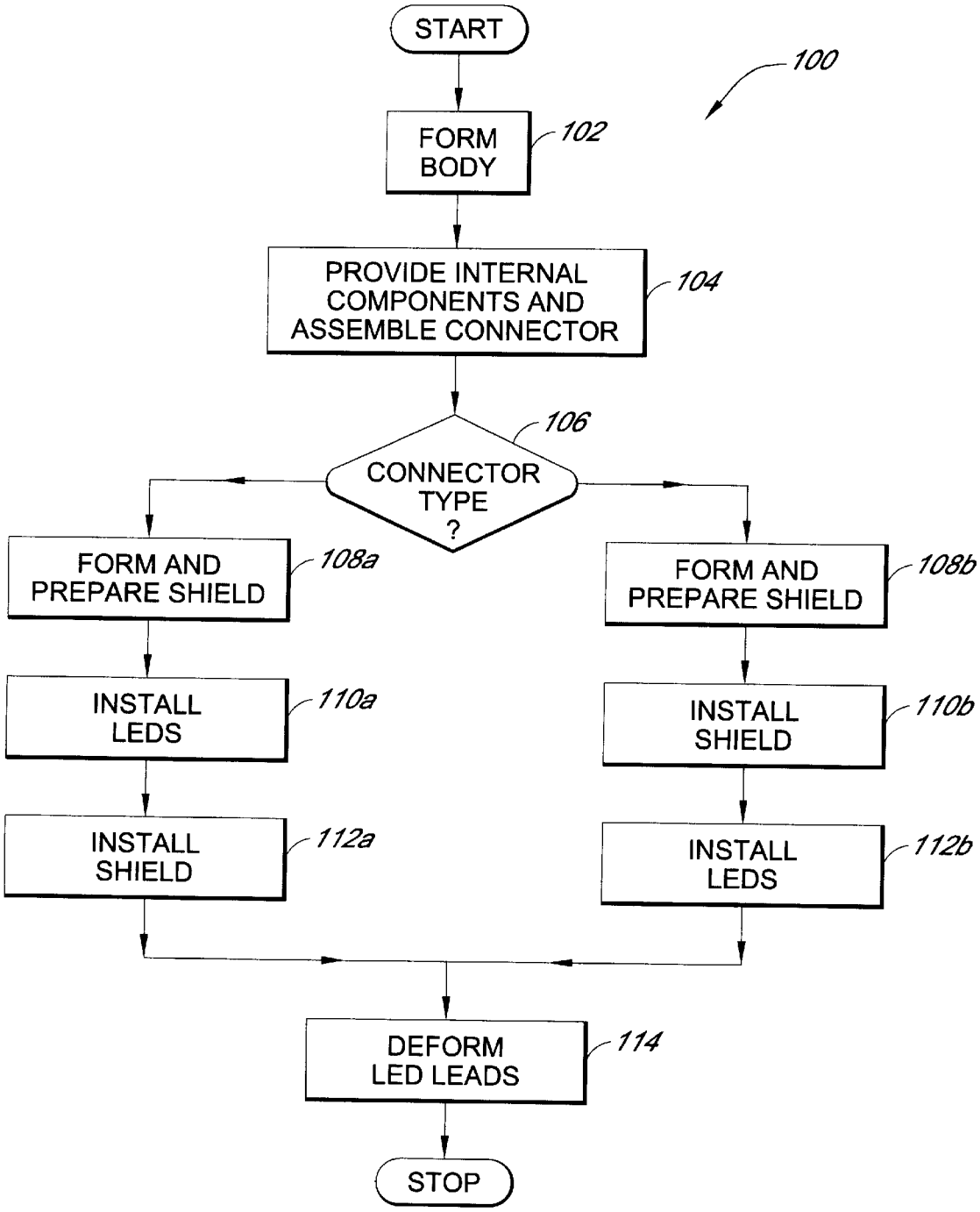
FIG. 4 is a flow diagram illustrating a method of fabricating the connector of the present invention.

Referring now to FIG. 4, a method 100 of fabricating the connectors previously described is disclosed. In a first step 102, the connector body 12 having the aforementioned channels 32, 33 and grooves 36, 38 is formed using any number of conventional molding techniques (such as injection molding, or transfer molding). In a second step 104, the internal components of the connector, such as the leads and magnetics, are installed within the connector body. The fabrication and assembly of such connector internal components is well known in the electrical arts, and accordingly will not be discussed further herein.

In a third step 106, the type of connector to be assembled is determined (i.e., whether the indicating devices (LEDs) 14 will bc located internally within the shield as in FIG. 2 above, or external to the shield as in FIG. 3 above. In the next step 108*a*, 108*b*, the appropriate shield 52 is formed. Next, the LEDs 14 are installed in step 110*a* (FIG. 2 embodiment), or the shield installed per step 110*b* (FIG. 3 embodiment). In step 112*a*, the shield is installed (or conversely, the LEDs installed in step 112*b*). Note that adhesive may be applied to the LEDs when installed. Lastly, the leads of the LEDs are deformed in step 114 so as to coincide with holes or terminals present on the circuit board (or other device to which the connector is being mounted).

While the foregoing method 100 is described in terms of a series of specific steps, it will be appreciated that the order of these steps may be permuted, or alternatively steps added or deleted as necessary, depending on the specific application and configuration of the connector being fabricated. For example, the leads 40 of the indicating devices may be deformed prior to installation of the shield, or prior to installation within the connector body 12. Many such variations are possible, and considered to be within the scope of the invention.

While the above detailed description has shown, described, and pointed out novel features of the invention as applied to various embodiments, it will be understood that various omissions, substitutions, and changes in the form and details of the device or process illustrated may be made by those skilled in the art without departing from the spirit of the invention.

What is claimed is:

1. A microelectronic connector, comprising:

a connector body having a plurality of walls, said walls defining a cavity, at least one recessed channel, and a board-mounting face, wherein said cavity is configured to receive a modular plug within said cavity, wherein the recessed channel has at least one land formed therein, wherein the land forms a groove bounded by an inner edge of the land and a portion of the connector body, and wherein the land has a recess in all outer edge thereof;

at least one indicating device comprising an LED, a first electrical lead and a second electrical lead, wherein said first and second electrical leads are configured to extend at least to the board-mounting face of the connector body, wherein the first electrical lead is frictionally received into the groove, and wherein the second electrical lead is received into the recess; and an electromagnetic noise shield including at least one attaching tab, said noise shield affixed around the connector body exposing the cavity and the board-mounting face, wherein the at least one attaching tab of said noise shield folds over an edge of one of the plurality of walls to secure said noise shield around the connector body and wherein a portion of the noise shield is directly adjacent the second electrical lead and retains the second electrical Lead in the recess.

2. The microelectronic connector of claim 1, wherein the at least one indicating device is secured to said connector body by an adhesive.

3. The microelectronic connector of claim 1, wherein the plurality of walls comprises a front wall, a back wall, a bottom wall, a top wall and a first side wall and a second side wall.

4. The microelectronic connector of claim 3, wherein the at least one recessed channel is formed at a bottom corner of the connector body at a junction of the front wall, the bottom wall and the first side wall.

5. The microelectronic connector of claim 4, wherein the at least one recessed channel is formed in the connector body such that the first side wall terminates at the recessed channel and does not define a side of the recessed channel, such that the outer edge of the land formed in the recessed channel is directly adjacent the noise shield.

6. A method of manufacturing a microelectronic connector, comprising:

forming a connector body, such that said body has a plurality of walls defining a cavity configured to receive a modular plug, wherein at least one of said plurality of walls has at least one recessed channel in a portion thereof, wherein said at least one channel has a land formed therein, wherein the land forms a groove bounded by an inner edge of the land and a portion of the connector body, and wherein a recess is formed in an outer edge of the land;

installing at least one indicating device in the connector such that a first lead portion of the indicating device is received by frictional fit into the at least one groove, and a second lead portion of the indicating device is received into the recess; and installing a shield on said connector body, said shield configured to substantially conform to at least a portion of said connector body, wherein the shield is directly adjacent the second electrical lead and is configured to retain the second electrical lead in the recess.

7. The method of manufacturing a microelectronic connector as recited in claim 6, wherein said connector body is formed by molding.

8. The method of manufacturing a microelectronic connector as recited in claim 6, wherein said shield is an electromagnetic noise shield.

9. The method of manufacturing a microelectronic connector as recited in claim 6, wherein said at least one indicating device is installed on said connector body with an adhesive.

10. A microelectronic connector comprising:

a connector body having a plurality of walls, said plurality of walls comprising a front wall, a back wall, a bottom wall, a top wall and a first side wall and a second side wall, said plurality of walls defining a cavity, a board-mounting face, and at least one recessed channel formed at a junction of the front wall, the bottom wall and the first side wall such that the first side wall terminates at the recessed channel and does not define a side of the recessed channel, wherein said cavity is configured to receive a modular plug within said cavity, and wherein the recessed channel has at least one land formed therein, such that the land forms a groove bounded by an inner edge of the land and a portion of the connector body, and wherein the land has a recess in an outer edge thereof;

at least one indicating device comprising first and second electrical leads for providing an electrical signal to said indicating device, said at least two electrical leads extending at least to the board-mounting face of the connector body, wherein the first electrical lead is frictionally received into the groove, and wherein the second electrical lead is received into the recess; and an electromagnetic noise shield including at least one attaching tab, said noise shield affixed about the connector body exposing the cavity and the board-mounting face, wherein the at least one attaching tab of said noise shield folds over an edge of one of the plurality of walls to secure said noise shield around the connector body and wherein a portion of the noise shield is directly adjacent the second electrical lead.

11. The microelectronic connector of claim 10, wherein the indicating device is a light-emitting diode.

12. The microelectronic connector of claim 10, wherein the indicating device is a liquid crystal display.

13. The microelectronic connector of claim 10, wherein the at least one indicating device is secured to said connector body by an adhesive.

* * * * *

UNITED STATES PATENT AND TRADEMARK OFFICE

CERTIFICATE OF CORRECTION

PATENT NO. : 6,325,664 B1
DATED : December 4, 2001
INVENTOR(S) : Someda et al.

It is certified that error appears in the above-identified patent and that said Letters Patent is hereby corrected as shown below:

Column 5,
Line 15, change “in all outer” to -- in an outer --.

Signed and Sealed this

Thirtieth Day of July, 2002

*Attest:*

*Attesting Officer*

JAMES E. ROGAN
*Director of the United States Patent and Trademark Office*